US007108260B2

(12) United States Patent
Biegelsen et al.

(10) Patent No.: US 7,108,260 B2
(45) Date of Patent: Sep. 19, 2006

(54) FLEXIBLE DIRECTOR PAPER PATH MODULE

(75) Inventors: David K. Biegelsen, Portola Valley, CA (US); Lars-Erik Swartz, Sunnyvale, CA (US); David G. Duff, Woodside, CA (US); Mark H. Yim, Palo Alto, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 122 days.

(21) Appl. No.: 10/740,705

(22) Filed: Dec. 19, 2003

(65) Prior Publication Data

US 2005/0179198 A1 Aug. 18, 2005

(51) Int. Cl.
*B65H 39/10* (2006.01)

(52) U.S. Cl. ..... 271/303; 271/186

(58) Field of Classification Search ..... 271/303, 271/186

See application file for complete search history.

(56) References Cited

U.S. PATENT DOCUMENTS

| | | | | | |
|---|---|---|---|---|---|
| 4,579,325 | A | * | 4/1986 | Pinckney et al. | 271/3.03 |
| 4,579,326 | A | * | 4/1986 | Pinckney et al. | 271/3.03 |
| 4,579,446 | A | | 4/1986 | Fujino et al. | |
| 4,925,178 | A | * | 5/1990 | Clabbers et al. | 271/186 |
| 5,536,002 | A | * | 7/1996 | Yoshida et al. | 271/264 |
| 5,629,762 | A | * | 5/1997 | Mahoney et al. | 399/364 |
| 6,129,349 | A | * | 10/2000 | Olbrich et al. | 271/186 |
| 6,132,352 | A | * | 10/2000 | Rider | 493/419 |
| 6,196,464 | B1 | | 3/2001 | Patterson et al. | |
| 6,394,446 | B1 | * | 5/2002 | Okamoto | 271/186 |
| 6,419,222 | B1 | * | 7/2002 | Morrison et al. | 271/186 |
| 6,478,298 | B1 | * | 11/2002 | Mandel | 271/298 |
| 6,550,762 | B1 | | 4/2003 | Stoll | |
| 6,595,518 | B1 | * | 7/2003 | Dobrindt | 271/303 |
| 6,612,566 | B1 | | 9/2003 | Stoll | |
| 6,764,236 | B1 | * | 7/2004 | Suzuki | 400/642 |
| 2003/0094746 | A1 | | 5/2003 | Shih | |
| 2005/0212199 | A1 | * | 9/2005 | Duff et al. | 271/264 |

FOREIGN PATENT DOCUMENTS

| | | | | |
|---|---|---|---|---|
| DE | 40 41 268 | A1 | | 6/1992 |
| JP | 59230955 | A | * | 12/1984 |
| JP | 62255326 | A | * | 11/1987 |
| JP | 63057437 | A | * | 3/1988 |
| JP | 63127946 | A | * | 5/1988 |
| JP | 01081757 | A | * | 3/1989 |
| JP | 05201602 | A | * | 8/1993 |
| JP | 05294532 | A | * | 11/1993 |

* cited by examiner

*Primary Examiner*—Gene O. Crawford
*Assistant Examiner*—Matthew J. Kohner
(74) *Attorney, Agent, or Firm*—Bever, Hoffman & Harms, LLP; Patrick T. Bever

(57) ABSTRACT

A flexible media transport system includes a director element having articulating tips that provide access to selected media paths. The director element(s) can be incorporated into a director module. Multiple director modules can then be combined into a highly flexible and reconfigurable media transport system. By implementing the joints between the articulating tips and the body of the director element such that a continuous surface is provided in the path of the flexible media, stubbing of the moving media can be avoided. The continuous-surface joint interface can be provided via flexible skins, monolithic articulating tip-director element structures, and preconfigured resilient plate structures, among others.

13 Claims, 12 Drawing Sheets

FLEXIBLE DIRECTOR PAPER PATH MODULE

BACKGROUND OF THE INVENTION

1. Field of the Invention

The invention relates to the field of flexible media handling, and in particular, to reconfigurable media path elements for use in media handling systems.

2. Related Art

Conventional paper transport systems, such as incorporated into printers and copiers, are typically custom-designed units. Each unit includes a heavy frame that defines one or more paper paths, and sets of pinch rollers that move sheets of paper through the paper paths. However, because prior art transport systems are custom designed to meet the differing needs of specific printing systems, field reconfigurability and programmable reconfigurability are generally not readily achievable.

Furthermore, to enhance paper-handling capabilities, it is desirable for a paper transport system to have redirecting capabilities that allow the paper transport system to transport different sheets of paper along different paper paths. Conventional paper transport systems typically use movable gates to provide this redirection capability.

For example, U.S. Pat. No. 5,303,017, issued Apr. 12, 1994 to Smith, describes a gate-based redirection mechanism, as shown in FIGS. 1A and 1B. In FIGS. 1A and 1B, two horizontal baffles 111 and 112 define a first paper path 114, while a sheet diversion chute 113 defines a second paper path 115. Pinch rollers 121, 122, and 123 can then move sheets of paper through paper paths 114 and 115, based on the orientation of a diverter gate 130.

In FIG. 1A, diverter gate 130 is in a horizontal position, thereby allowing pinch rollers 121 and 122 to pass a sheet of paper through first paper path 114 in a transport direction 101. In FIG. 1B, diverter gate is rotated downwards (in a diagonal orientation), thereby blocking paper path 114 and allowing pinch rollers 122 and 123 to pass a sheet of paper through second paper path 115 in a transport direction 102.

In this manner, diverter gate 130 controls the paper transport direction in FIGS. 1A and 1B. However, as the speed and routing requirements placed on paper transport systems increase, elements such as diverter gate 130 can limit paper transport capabilities.

Specifically, the "joint" of diverter gate 130 (i.e., the region where diverter gate 130 makes a movable interface with the frame (baffle 111)) creates a surface discontinuity in the paper path. This discontinuity limits the reliability and performance of the transport system by creating a location at which the edges of paper sheets can catch or stub, particularly if the sheets are curled or have flaws such as "dog ears". This stubbing problem is exacerbated as the speed of the paper transport is increased.

Note that while diverter gate 130 can sometimes be shaped to reduce the effects of the surface discontinuity in one direction, the joint will typically not be suitable for paper transport in the reverse direction. For example, in FIG. 1A, the tapered profile of diverter gate 130 presents a relatively non-stubbing paper path 114 in transport direction 101, attempting to move paper in the opposite direction would result in stubbing at joint A.

Accordingly, it is desirable to provide a system and method for creating highly configurable and high-performance paper transport systems which eliminate the causes of stubbing and jams.

SUMMARY OF THE INVENTION

The invention provides a highly configurable, high-performance media transport system through the use of director elements having articulating tips. The articulating tips provide a simple means for media direction and re-direction, and can be incorporated into a director module for improved media transport system flexibility and can be implemented with continuous-surface joints for improved media transport system reliability.

According to an embodiment of the invention, a media director module can incorporate multiple media paths and a director element that includes articulating tips. The articulating tips of the director element control access to the media paths and provide a simple means for controlling the transport direction of media through the media director module. Then, by incorporating multiple media director modules into a media transport system (such as in a high-speed printer or copier), complex media routing paths can be readily provided.

According to an embodiment of the invention, the articulating tips of the director element can comprise a simple gate-type structure connected to the director element via a rotating joint. According to another embodiment of the invention, the articulating tips can be formed by creating living hinges in the director element body. A flipper mechanism in the articulating tip can then provide the desire rotational movement of the tip relative to the director element body.

According to another embodiment of the invention, the media-handling performance provided by the articulating tips can be improved by creating a continuous surface across the joints between the articulating tips and the director element body. By eliminating surface discontinuities, the potential for media stubbing is minimized, thereby allowing faster media throughput and presenting the opportunity for bi-directional media transport.

According to an embodiment of the invention, a director element can include a body portion and an articulating tip, all covered by a flexible skin. The portion of the flexible skin covering the body portion of the director element provides guide surfaces that define the media paths provided by the director module. The flexible skin also maintains a continuous surface across the joint between the articulating tip and the body portion, even as the articulating tip changes position relative to the body portion of the director element.

According to another embodiment of the invention, the entire director element can be formed from a flexible material, with the tip(s) of the director element being driven by an internal flipper(s). By changing the orientation (and/or position) of the flipper, the orientation of the tip of the director element can be adjusted relative to the body of the director element. By creating the director element to have a continuous surface between its tip(s) and its guide surfaces, surface discontinuities at the articulating tip joint(s) can be prevented.

According to another embodiment of the invention, an articulating tip can be formed by configuring two resilient plates to have default positions that force the ends of the resilient plates towards one another. A flipper placed between the resilient plates can then adjust the position of the articulating tip formed by the contacting ends of the plates. The non-end portions of the resilient plates form the body of the director element and provide guide surfaces for the media paths defined by the director module. Therefore, the resilient plates provide an articulating tip that maintains a continuous surface with the guide surfaces of the director element.

BRIEF DESCRIPTION OF THE DRAWINGS

These and other features, aspects and advantages of the present invention will become better understood with regard to the following description, appended claims, and accompanying drawings, where:

DETAILED DESCRIPTION

Figure 1A:
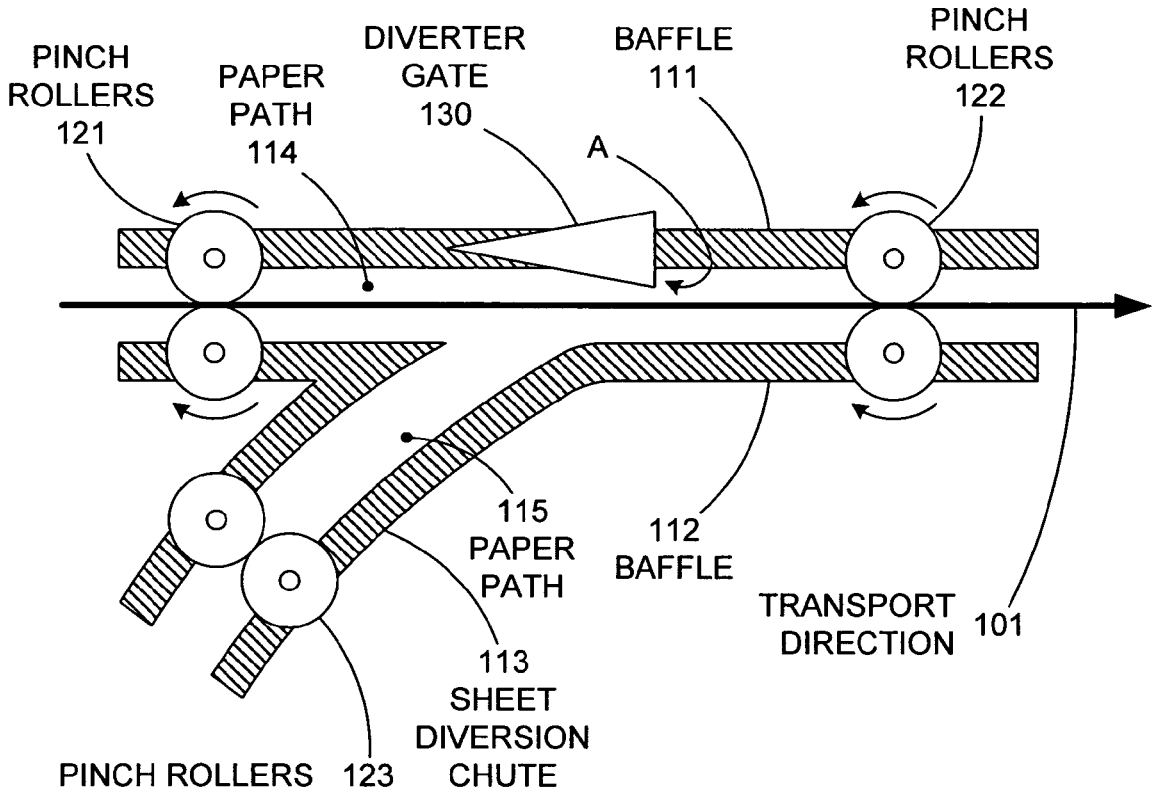
FIG. 1A (PRIOR ART)
FIGS. 1A and 1B show a conventional media redirection mechanism.
Figure 1B:
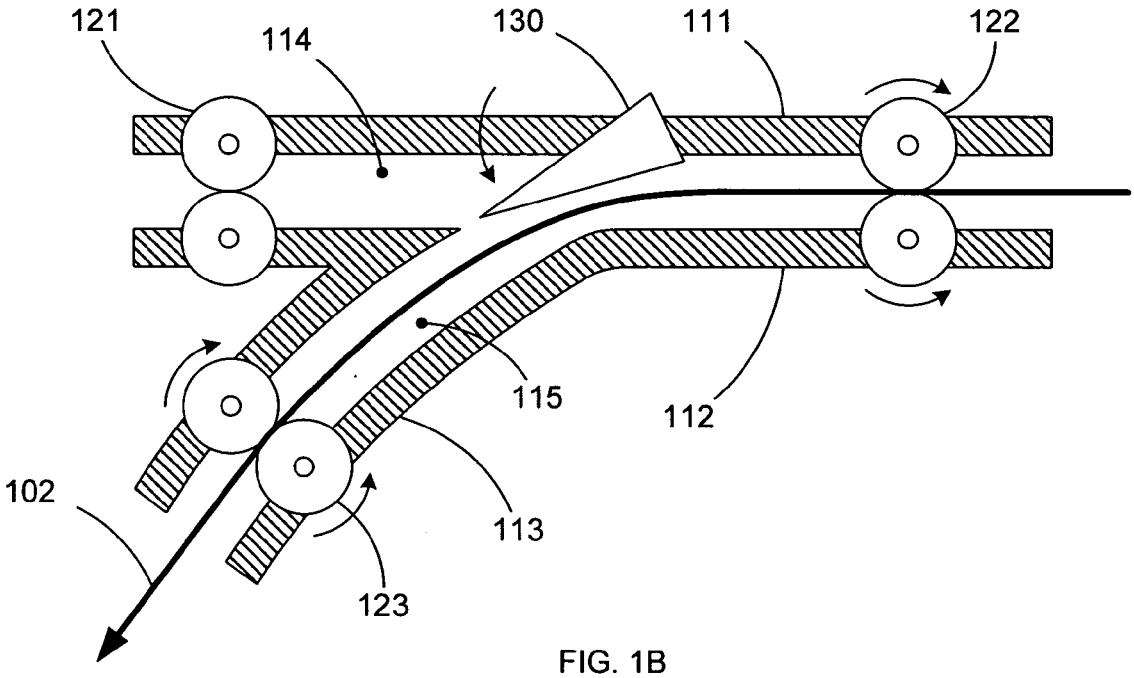
FIG. 1B (PRIOR ART)
Figure 2A:
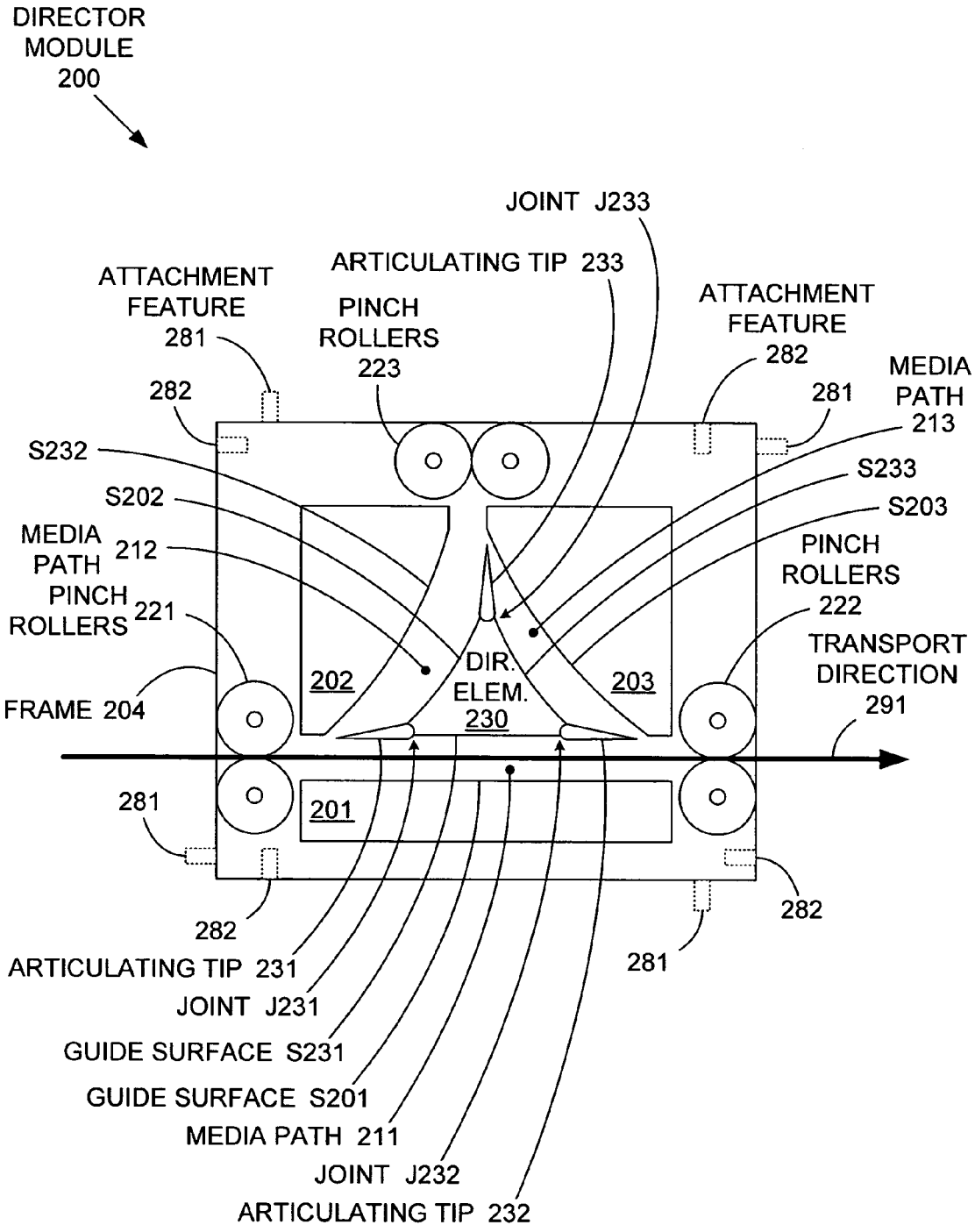
FIGS. 2A, 2B, and 2C show a media director module according to an embodiment of the invention.

FIG. 2A is a director module 200 for controlling the transport direction of flexible media, such as sheets of paper or cardboard, according to an embodiment of the invention. A director module beneficially eliminates the need for expensive, custom-designed media transport systems by allowing such media transport systems to be created from standardized subunits, as described in co-owned, co-pending U.S. patent applications [A3012] and [A3013], herein incorporated by reference.

Director module 200 includes a frame 204, pinch rollers 221, 222, and 223, and a director element 230. Frame 204 can comprise any substantially rigid structure that provides support for the components of director module 200 (e.g., a backplane, a mounting plate, or a device housing, among others). A plurality of optional attachment features 281 and 282 allow director module 200 to be assembled to other director modules (or to other elements in a larger media handling system). Note that while pin (feature 281) and socket (feature 282) features are depicted for exemplary purposes, a director module in accordance with the invention can include any type of attachment feature(s).

Frame 204 includes fixed guide elements 201, 202, and 203. Guide surfaces S201, S202, and S203 on fixed guide elements 201, 202, and 203, respectively, face guide surfaces S231, S232, and S233, respectively, on director element 230 to define media paths 211, 212, and 213, respectively. Note that while three media paths are shown for exemplary purposes, a director module in accordance with the invention can define any number of media paths.

Pinch rollers 221, 222, and 223 drive flexible media into and out of media paths 211, 212, and 213. Note that while pinch rollers are depicted as media driving elements for exemplary purposes, a director module in accordance with the invention can include any other driving means, including spherical nip actuators (as described in U.S. Pat. No. 6,059,284 to Wolf et al.) or piezoelectrically driven brushes (as described in U.S. Pat. No. 5,467,975 to Hadimioglu et al.).

Director element 230 includes a set of articulating tips 231, 232, and 233. Articulating tips 231, 232, and 233 move relative to the body of director element 230 at joints J231, J232, and J233, respectively. By controlling the positioning of articulating tips 231–233, access can be provided to (and egress can be provided from) a selected one of media paths 211, 212, and 213. For example, in FIG. 2A, articulating tips 231 and 232 are rotated to a substantially horizontal position, thereby allowing pinch rollers 221 and 222 to drive media through media path 211 in a transport direction 291. Note that the media could also be driven in the opposite direction (i.e., the reverse of transport direction 291).

Figure 2B:
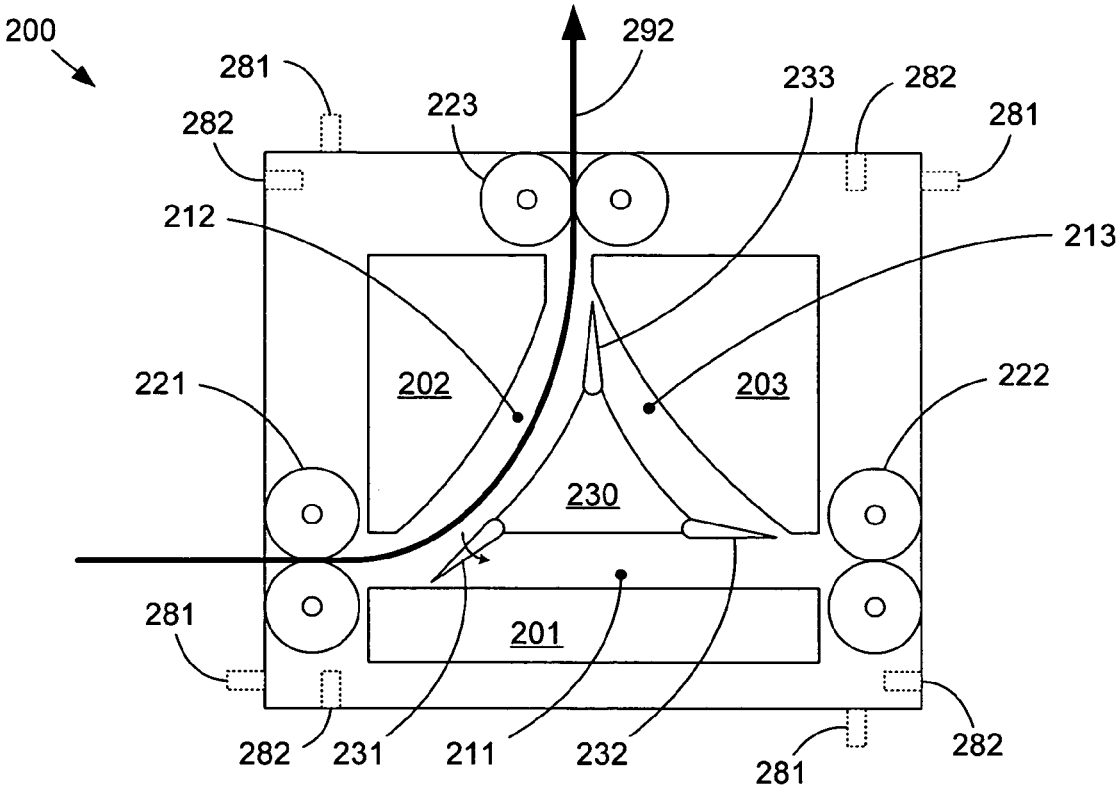

In FIG. 2B, articulating tip 231 is rotated towards fixed guide element 201 (in the direction of the arrow), while articulating tip 233 is in a substantially vertical position. Pinch rollers 221 and 223 can then drive media through media path 212 in a transport direction 292. Note that the media could also be driven in the opposite direction (i.e., the reverse of transport direction 292).

Figure 2C:
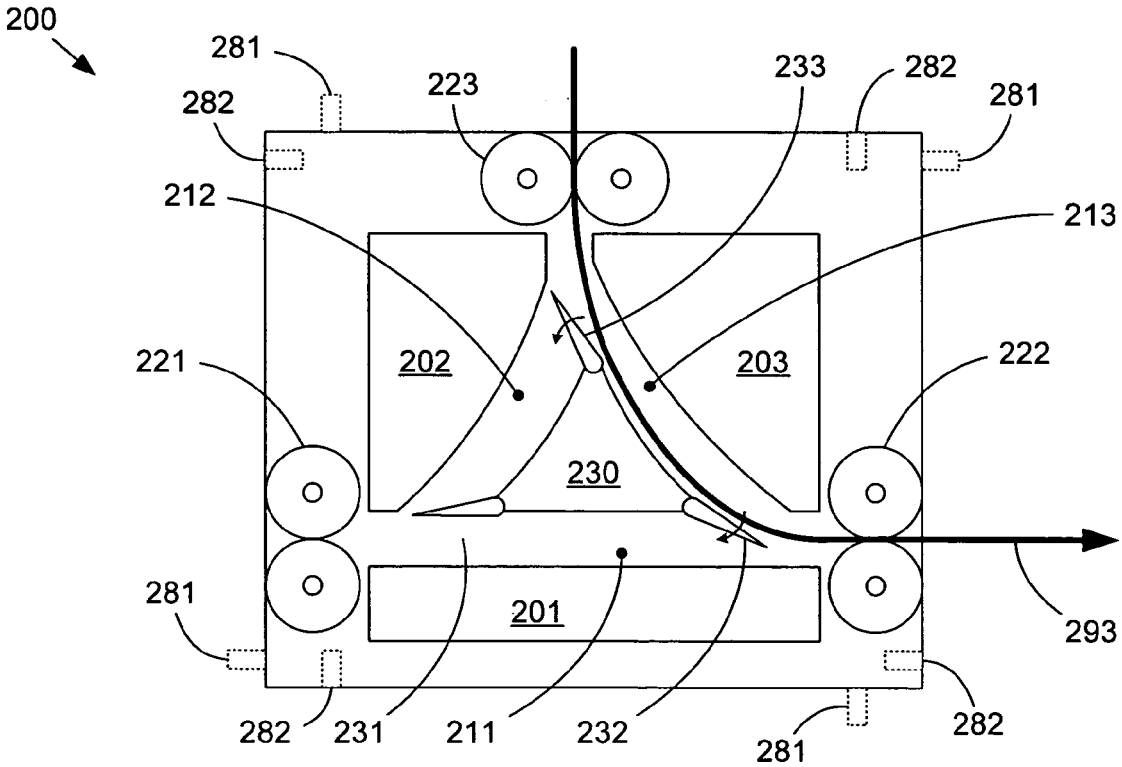

In FIG. 2C, articulating tip 233 is rotated towards fixed guide element 202 (in the direction of the arrow), while articulating tip 232 is rotated towards fixed guide element 201 (in the direction of the arrow). Pinch rollers 223 and 222 can then drive media through media path 213 in a transport direction 293. Note that the media could also be driven in the opposite direction (i.e., the reverse of transport direction 293).

In this manner, director module 200 provides a simple means for selectably driving media though various different media paths. Note that just as the number of media paths in director module 200 can vary, so can the number of articulating tips. Furthermore, while articulating tips 231, 232, and 233 are described as having two operating positions for exemplary purposes (e.g., articulating tip 231 can either be rotated towards fixed guide element 202 or 201 to provide access to media paths 211 and 212, respectively), an articulating tip in accordance with the invention could have any number of operating positions. For example, an articulating tip could switch between three different positions to control access to three different media paths.

Figure 2D:
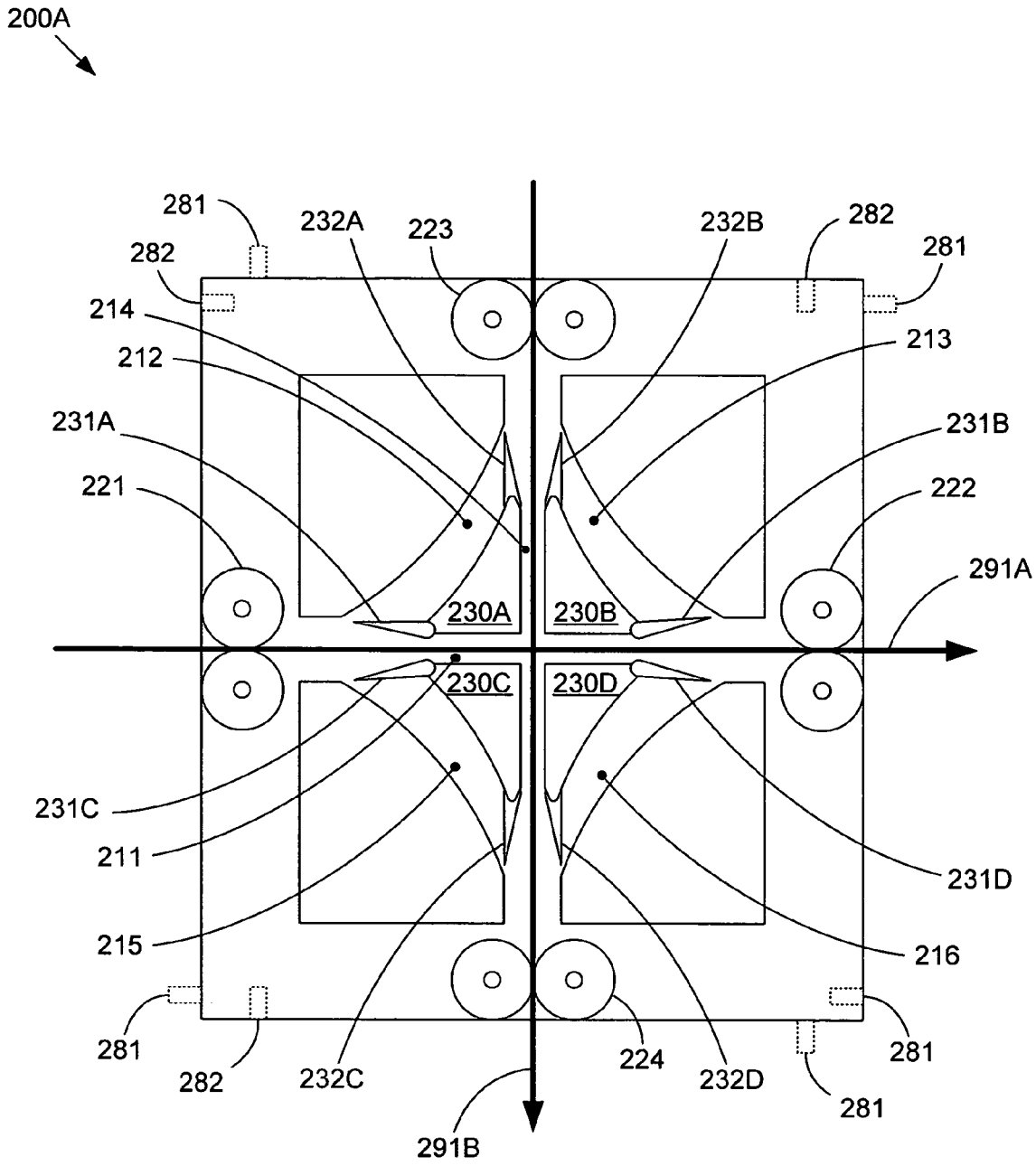
FIGS. 2D, 2E, and 2F show a media director module according to another embodiment of the invention.

Note further that a director module in accordance with the invention can include any number of director elements. For example, FIG. 2D shows a director model 200A in accordance with another embodiment of the invention. Director module 200A includes director elements 230A, 230B, 230C, and 230D. Director element 230A includes articulating tips 231A and 232A, director element 230B includes articulating tips 231B and 232B, director element 230C includes articulating tips 231C and 231D, and director element 230D includes articulating tips 231D and 232D.

Each adjacent pair of articulating tips (i.e., tips 231A and 231C, tips 232A and 232B, tips 231B and 231D, and tips 232C and 232D) works in combination to provide access to one of three media paths. For example, in FIG. 2D, each tip pair is spread apart, thereby allowing access to media paths 211 and 214, which run between director elements 230A, 230B, 230C, and 230D and allow media to travel in transport directions 291A and 291B, respectively.

Figure 2E:
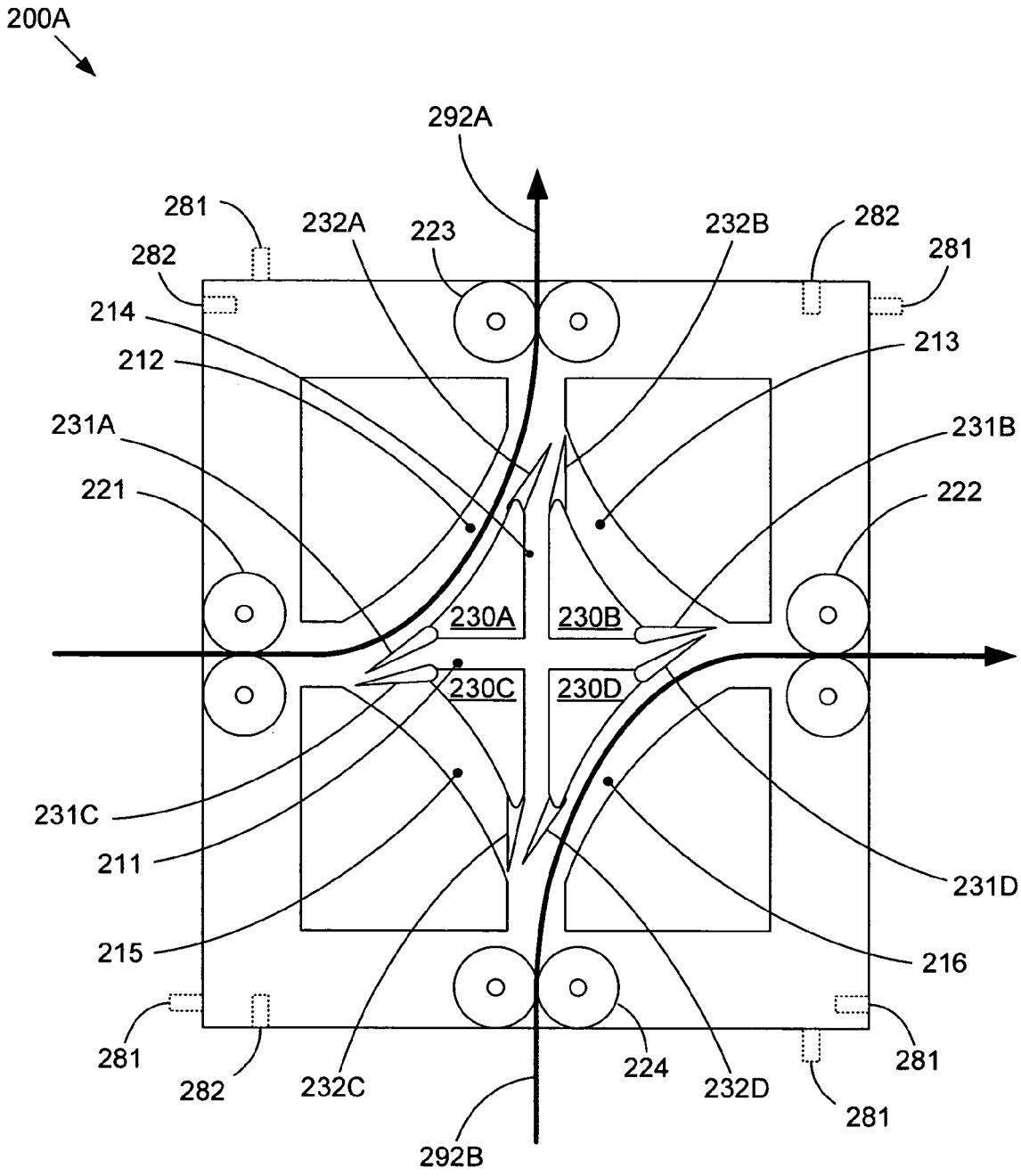

Next, in FIG. 2E, articulating tips 231A and 232A of director element 230A are rotated towards articulating tips 231C and 232B, respectively, thereby providing access to a media path 212 that defines a transport direction 292A. Meanwhile, articulating tips 231D and 232D of director element 230D are rotated towards articulating tips 231B and 232C, respectively, thereby providing access to a media path 216 that defines a transport direction 292B.

Figure 2F:
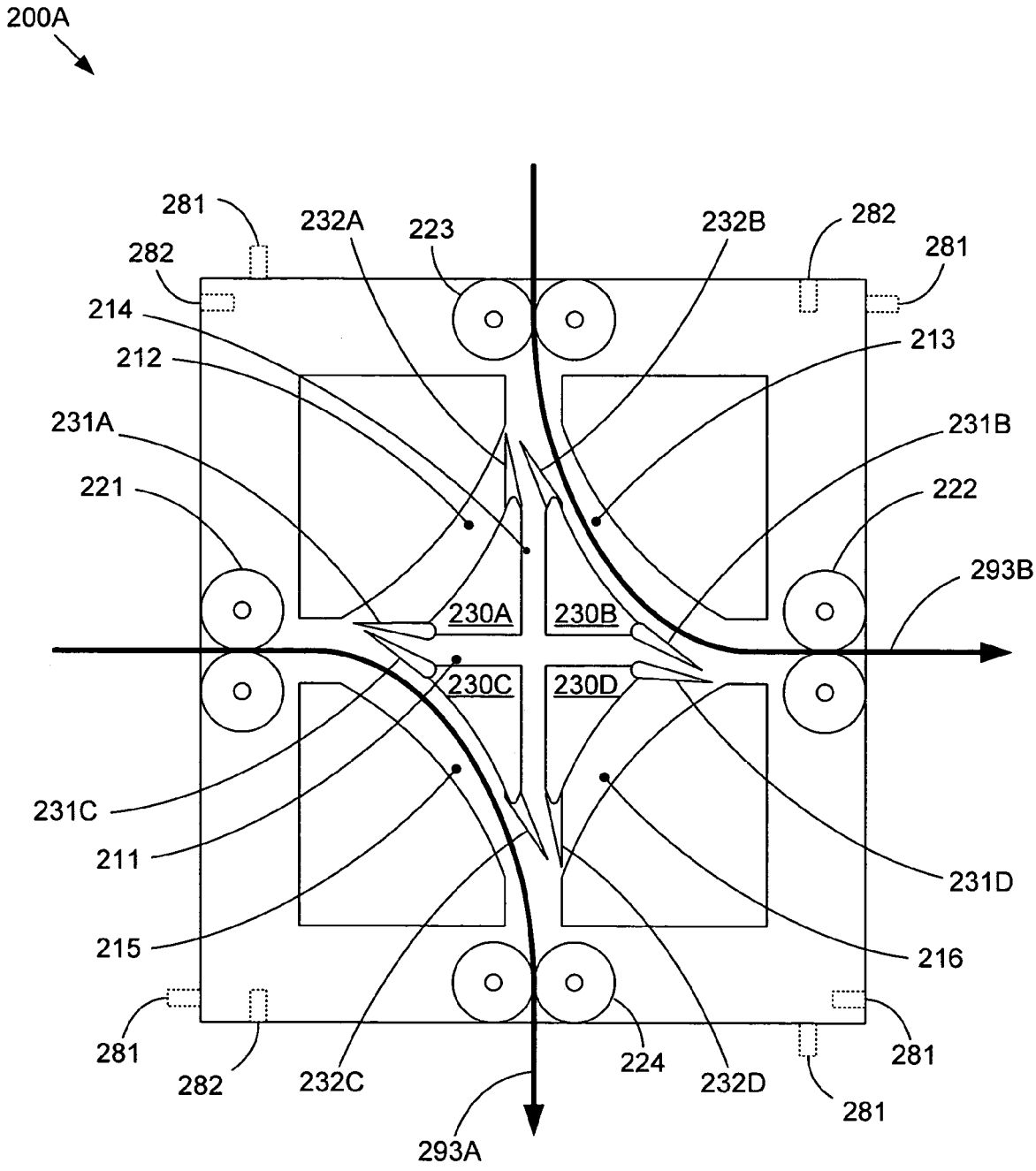

Finally, in FIG. 2F, articulating tips 231C and 232C of director element 230C are rotated towards articulating tips 231A and 232D, respectively, thereby providing access to a media path 215 that defines a transport direction 293A. Meanwhile, articulating tips 232B and 231B of director element 230B are rotated towards articulating tips 232A and 231D, respectively, thereby providing access to a media path 213 that defines a transport direction 293B. Various other transport operations (e.g., path splitting/merging) can be performed by director module 200A through appropriate positioning of articulating tips 231A, 232A, 231B, 232B, 231C, 232C, 231D, and 232D.

Figure 3A:
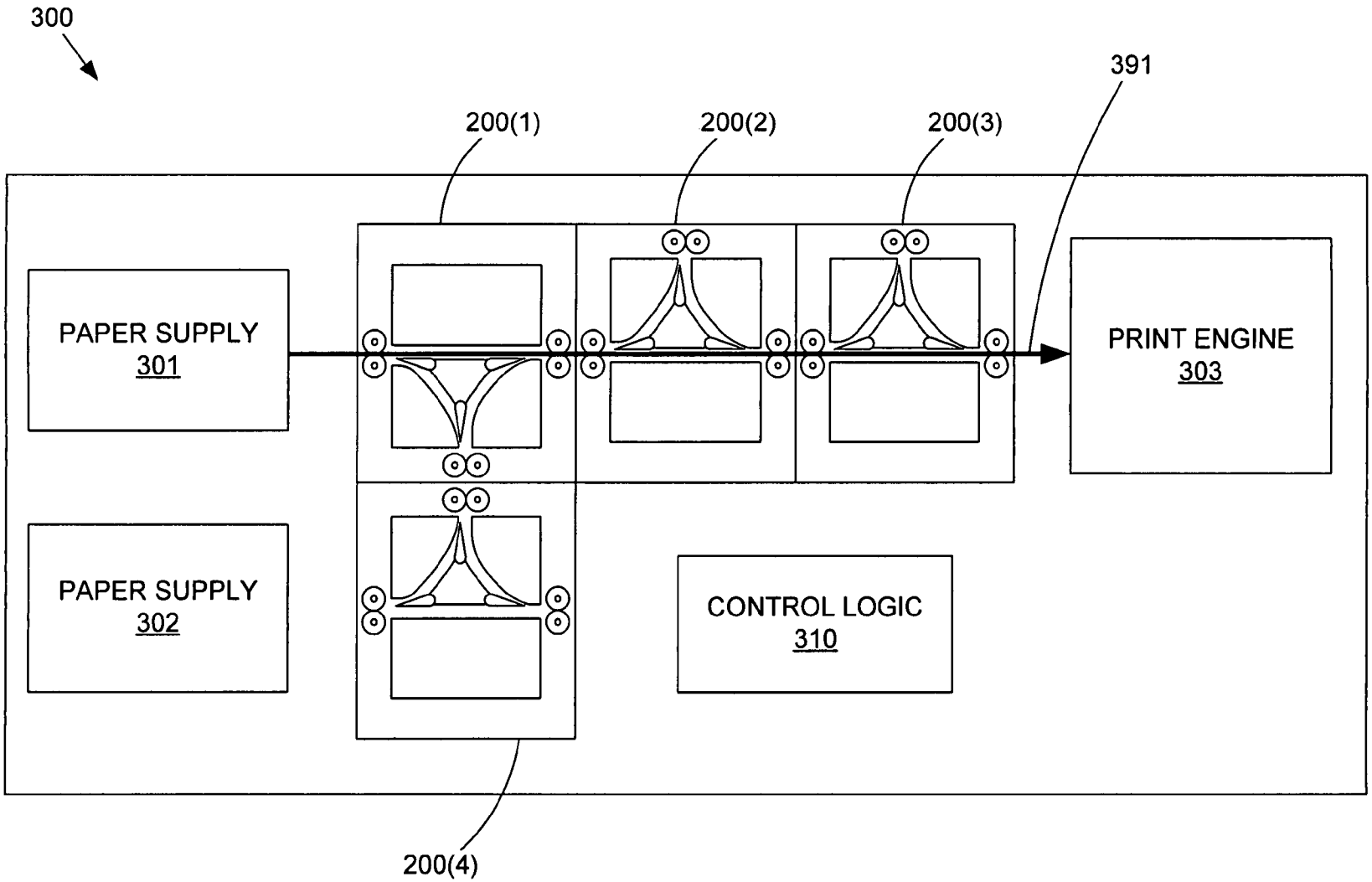
FIGS. 3A and 3B show a printing system incorporating a media transport system formed from media director modules shown in FIGS. 2A–2C, according to an embodiment of the invention.

According to an embodiment of the invention, complex media routing requirements can be satisfied by linking multiple director modules 200 in a single media handling system. FIG. 3A shows a printing system 300 in accordance with an embodiment of the invention. Printing system 300 includes identical director modules 200(1), 200(2), 200(3), and 200(4), each of which is substantially similar to director module 200 shown in FIGS. 2A–2C. Note that according to an embodiment of the invention, director modules in a media handling system can have different orientations, as shown by director module 200(3), which is upside-down relative to director modules 200(1), 200(2), and 200(4).

Printing system 300 also includes paper supplies 301 and 302, a print engine 303, and control logic 310. Control logic 310 includes software or hardware (e.g., sensors and circuits) logic for controlling the articulating tips of director modules 200(1)–200(4) to direct media from one of paper supplies 301 and 302 to print engine 303 according to the requirements for a given print job.

Figure 3B:
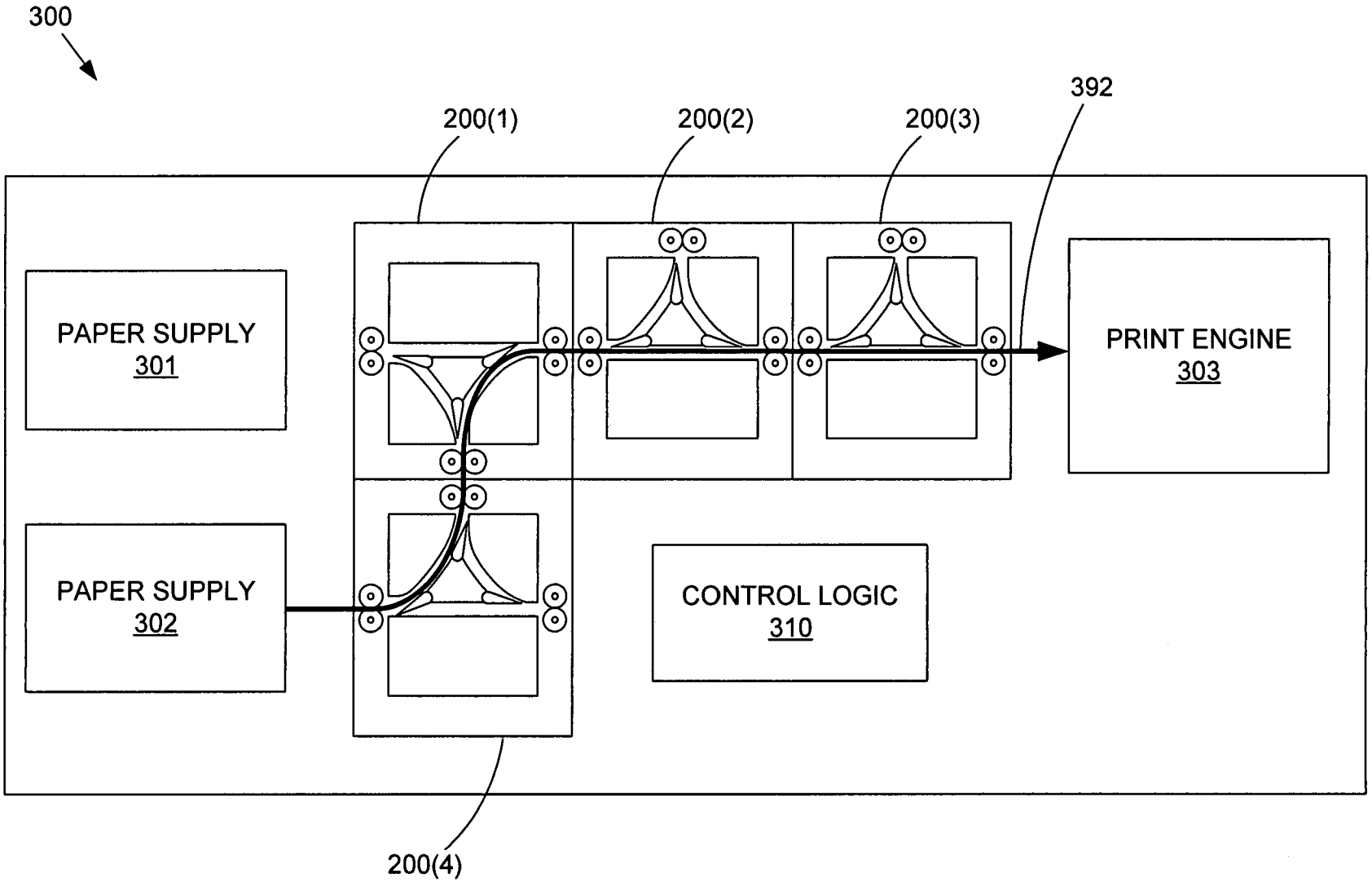

For example, as shown in FIG. 3A, the articulating tips of director modules 200(1), 200(2), and 200(3) are all oriented in a substantially horizontal manner, thereby defining a "straight through" media transport direction 391 that leads from paper supply 301 to print engine 303. However, in FIG. 3B, the articulating tips of director module 200(1) are positioned so that director module 200(3) blocks its horizontal media path and provides access to a media path originating from director module 200(4). Meanwhile, the articulating tips of director module 200(4) provide access to a media path that leads from paper source 302 to director module 200(*a*), thereby defining an overall media transport direction 392 that directs media from paper supply 302 to print engine 302.

In this manner, director modules 200(1)–200(4) provide a simple means for constructing a paper handling system that can selectively provide media from different sources (301 and 302) to print engine 303. Note that while media paths between two paper supplies and a print engine are described for exemplary purposes, director modules 200 can be used to provide configurable media paths between any type and arrangement of media stations (e.g., paper supplies, print engines, staging areas, reader systems, and binding systems, among others).

Returning to FIG. 2A, note that while articulating tips 231, 232, and 233 shown in FIG. 2A are depicted as having substantially wedge-shaped cross sections for exemplary purposes, articulating tips in accordance with the invention can comprise any cross sectional shape (e.g., rectangular, oblong, or curved). In addition, a single director module 200 could include articulating tips having a variety of different shapes, sizes, and configurations.

Furthermore, while articulating tips 231, 232, and 233 are depicted as simple gate-type structures for exemplary purposes, articulating tips in accordance with the invention can be implemented using any mechanism that provides the desired tip movement for director element 230. Furthermore, as noted above, it is desirable that potential stubbing points in the media path be eliminated to optimize media transport system configurability and reliability. Therefore, according to another embodiment of the invention, joints J231–233 of director module 200 shown in FIG. 2A are implemented such that a continuous surface is provided between articulating tips 231–233 and the guide surfaces of director element 230.

Figure 4A:
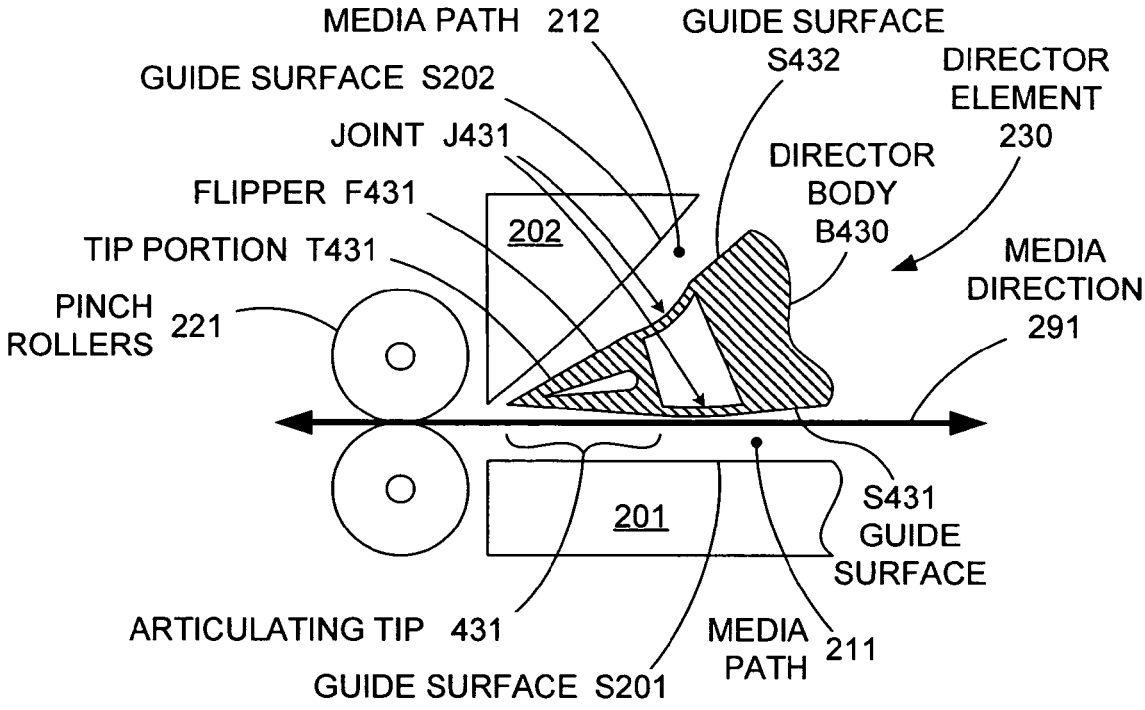
FIGS. 4A and 4B show an articulating tip that includes a living hinge, according to an embodiment of the invention.

For example, FIG. 4A shows a detail view of an articulating tip 431 that could be used in place of articulating tip 231 in FIG. 2A, according to an embodiment of the invention. Articulating tip 431 includes a tip portion T431 and a flipper F431 that is embedded within tip portion T431. Tip portion T431 is part of a larger director body B430 that makes up director element 230. Director body B430 includes guide surfaces S431 and S432 that converge towards tip portion T431. Guide surfaces S431 and S432 face guide surfaces S201 and S202, respectively, of fixed guide elements 201 and 202, respectively, to define media paths 211 and 212, respectively.

Director body B430 is formed from plastic or metal, thereby allowing a joint J431 connecting tip portion T431 to director body B430 to be formed from a pair of living hinges. Living hinges are thin, flexible webs that are often formed by coining or extrusion and are used to provide reliable hinge structures. The length and thickness of a living hinge depends on the amount of flexion required and the material being used. For example, if tip portion T431 is roughly 2 mm from axis to nearest surface and the total rotation of tip portion T431 during normal operation is roughly 30°, joint J431 could be implemented in plastic using living hinges having a rough length of 10 mm and a rough thickness of 0.1–1.0 mm. Note that while a "double living hinge" (i.e., pair of living hinges forming a single joint) is shown for exemplary purposes, joint J431 can include any number and type of living hinges.

Meanwhile, flipper F431 is a lever element that is rotated (or translated) by an external drive mechanism (not shown for clarity) to control the orientation of tip portion T431. As flipper F431 is rotated (or translated), the flexible living hinges at joint J431 allow the position of tip portion T431 to be adjusted relative to director body B430 and provide access to one of media paths 211 and 212, while maintaining a continuous surface in the selected media path.

For example, in FIG. 4A, flipper F431 rotates tip portion T431 towards guide surface S202, thereby providing access to media path 211 (and blocking media path 212). Pinch rollers 221 can then drive media in a media direction 291 through media path 211. Because the flexible living hinges of joint J431 eliminate surface discontinuities in the media path at joint J531, pinch rollers 221 can also drive media in the opposite direction (as indicated by the two-headed arrow) at high speed without encountering stubbing at joint J431.

Figure 4B:
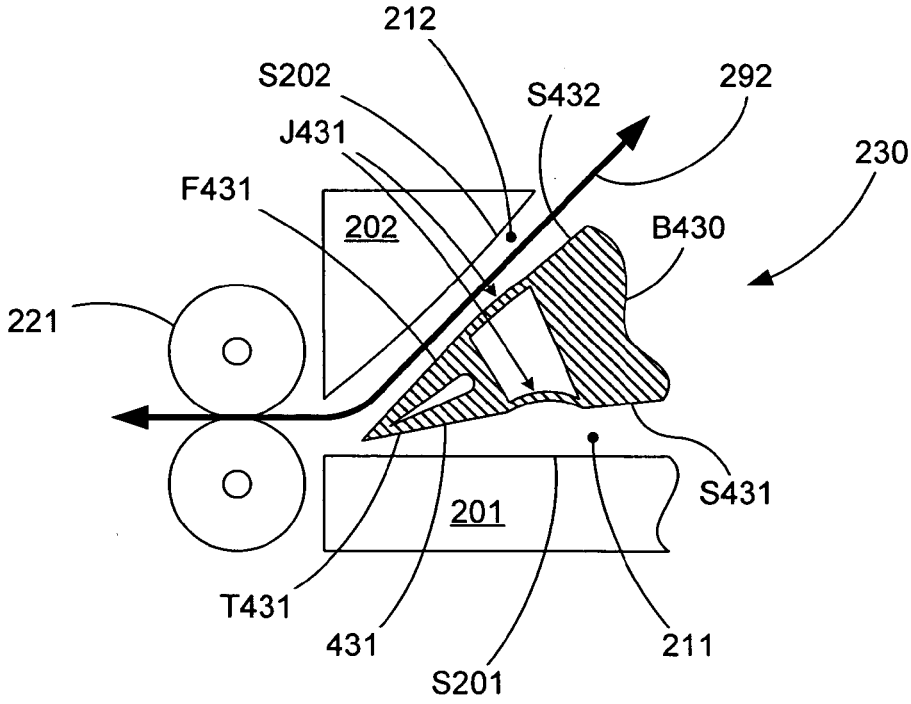

In FIG. 4B, flipper F431 rotates tip portion T431 towards guide surface S201, thereby providing access to media path 212 (and blocking media path 211). Pinch rollers 221 can then drive media in a media direction 292 through media path 212. Once again, because the living hinges of joint J431 eliminate surface discontinuities (stubbing points) at joint J431, pinch rollers 221 can also drive media in the opposite direction (as indicated by the two-headed arrow) at high speed without encountering stubbing at joint J431. In this manner, articulating tip 431 can improve the bi-directional paper transport capabilities of a director module (e.g., director module 200 shown in FIG. 2A).

Figure 5A:
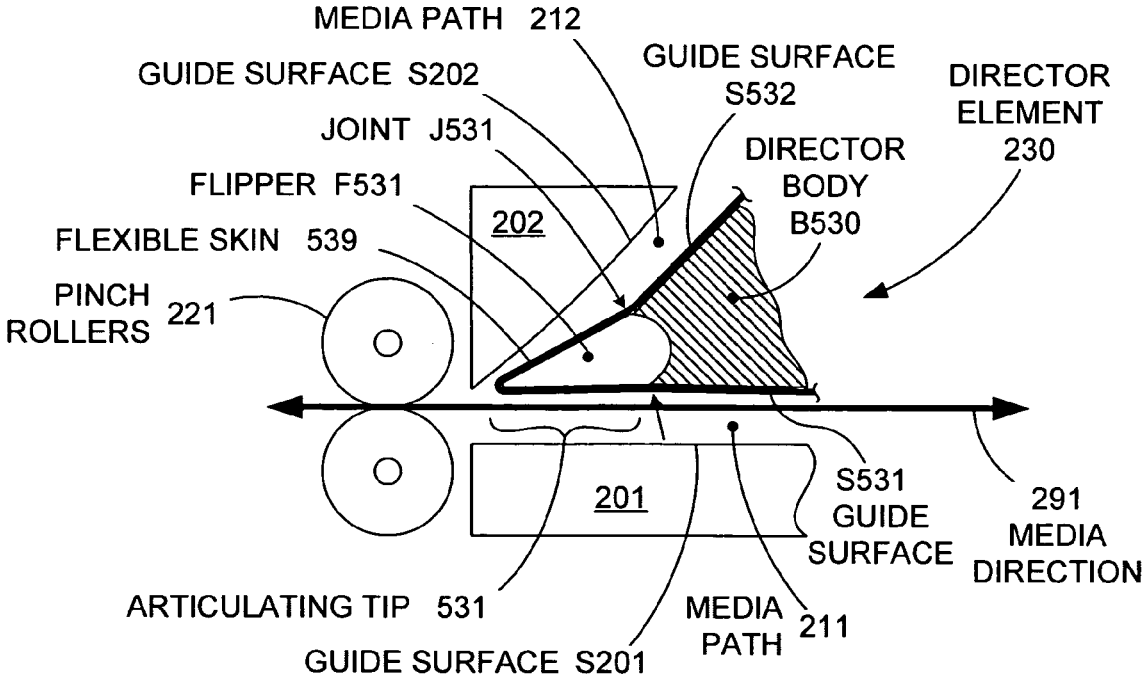
FIGS. 5A and 5B show an articulating tip that includes an exterior skin, according to another embodiment of the invention.

FIG. 5A shows a detail view of an articulating tip 531 that could be used in place of articulating tip 231 in FIG. 2A, according to an embodiment of the invention. Articulating tip 531 includes a flipper F531 that is attached to a director body B530 by a rotational joint J531 to form director element 230. A flexible skin 539 covers flipper F531 and director body B530. According to an embodiment of the invention, flexible and stretchable skin 539 is form-fit (e.g., heat-shrunk and selectively adhered) to the exterior of flipper F531 and director body B530. According to another embodiment of the invention, flexible skin 539 is vacuum-sealed against the exterior of flipper F531 and director body B530 and optionally glued in place at selected places on the director body B530.

Flexible skin 539 provides guide surfaces S531 and S532 that converge towards and cover flipper F531 to ensure that a continuous surface is maintained across joint J531. Guide surfaces S531 and S532 face guide surfaces S201 and S202, respectively, of fixed guide elements 201 and 202, respectively, to define media paths 211 and 212, respectively.

When flipper F431 is rotated by an external drive mechanism (not shown for clarity) towards guide surface S202, access is provided to media path 211 (and media path 212 is blocked). Pinch rollers 221 can then drive media in a media direction 291 through media path 211. Because flexible skin 539 eliminates surface discontinuities at joint J531, pinch rollers 221 can also drive media in the opposite direction (as indicated by the two-headed arrow) at high speed without encountering stubbing at joint J531.

Figure 5B:
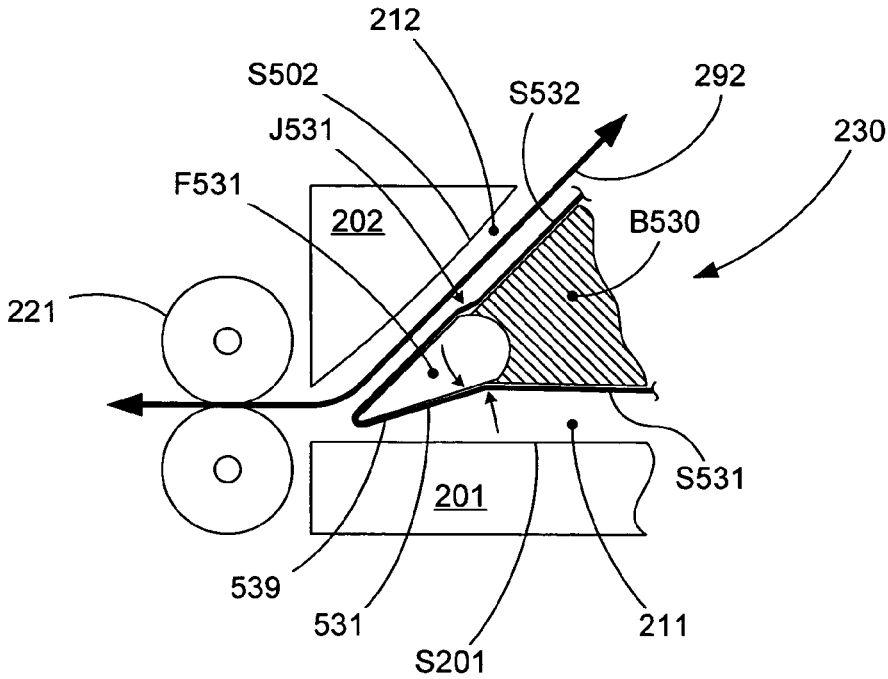

In FIG. 5B, flipper F431 is rotated towards guide surface S201, thereby providing access to media path 212 (and blocking media path 211). Pinch rollers 221 can then drive media in a media direction 292 through media path 212. Once again, because flexible skin 539 eliminates surface discontinuities (stubbing points) at joint J531, pinch rollers 221 can also drive media in the opposite direction (as indicated by the two-headed arrow) at high speed without encountering stubbing at joint J531. In this manner, articulating tip 531 can improve the bi-directional paper transport capabilities of a director module (e.g., director module 200 shown in FIG. 2A).

Figure 6A:
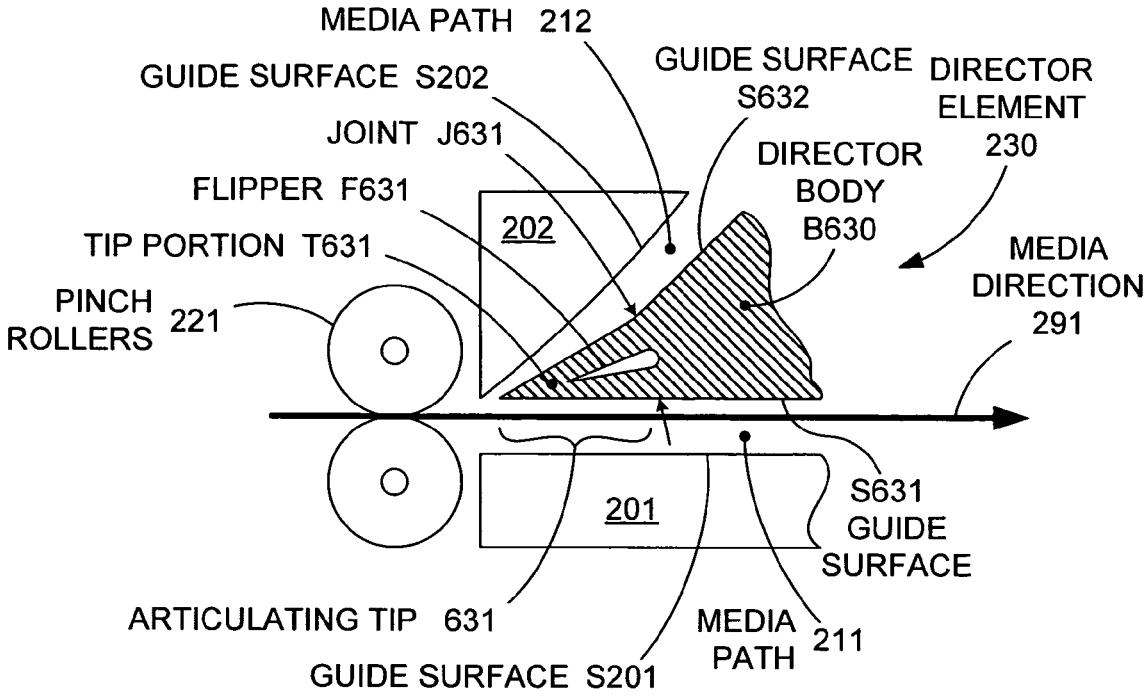
FIGS. 6A and 6B show an articulating tip that is formed as a one-piece, flexible element, according to another embodiment of the invention.

FIG. 6A shows a detail view of an articulating tip 631 that could be used in place of articulating tip 231 in FIG. 2A, according to another embodiment of the invention. Articulating tip 631 includes a tip portion T631 and a flipper F631 that is embedded in tip portion T631. Tip portion T631 is part of a larger director body B630 that makes up director element 230. Director body B630 includes guide surfaces S631 and S632 that converge towards tip portion T631. Guide surfaces S631 and S632 face guide surfaces S201 and S202, respectively, of fixed guide elements 201 and 202, respectively, to define media paths 211 and 212, respectively.

Director body B630 is formed from a flexible material that allows flexion to occur between tip portion T631 and director body B630 at a joint J631. For example, according to an embodiment of the invention, director body B630 and tip portion T631 can be an extruded plastic, rubber, or even thin metal element. Because tip portion T631 and director body B630 are actually a single monolithic element, when flipper F631 is rotated by an external drive mechanism (not shown for clarity) to move tip portion T631 relative to director body B630, surface continuity is maintained across joint J631 and stubbing points are eliminated. Director body B630 and tip portion T631 can be a composite structure with, for example, a low friction, flexible skin layer bonded to the inner core material.

Thus, when flipper F631 rotates tip portion T631 towards guide surface S202, as shown in FIG. 6A, access is provided to media path 211 (and media path 212 is blocked). Pinch rollers 221 can then drive media in a media direction 291 through media path 211. Because the monolithic design of tip portion T631 and director body B630 eliminates surface discontinuities at joint J631, pinch rollers 221 can also drive media in the opposite direction (as indicated by the two-headed arrow) at high speed without encountering stubbing at joint J631.

Figure 6B:
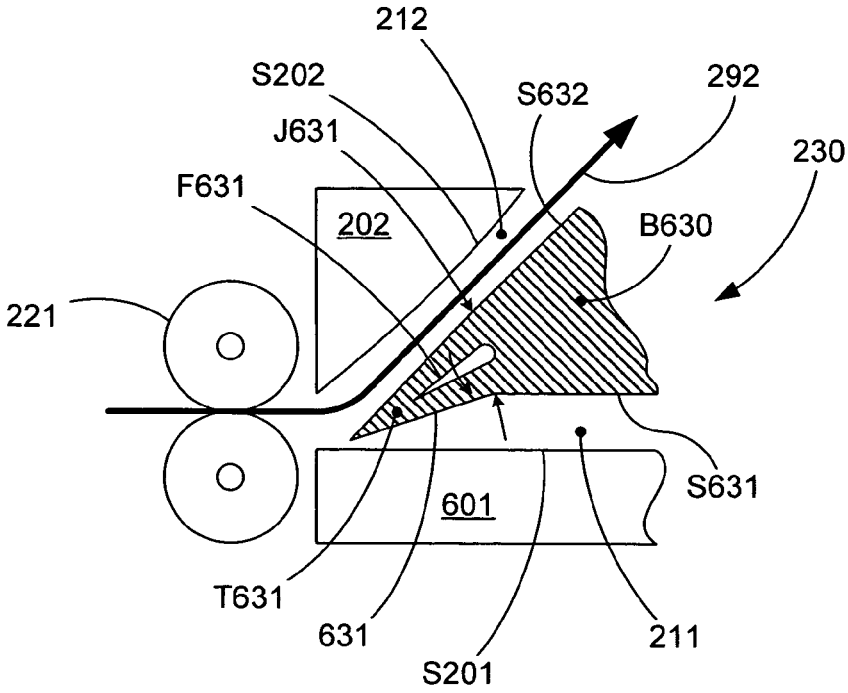

In FIG. 6B, flipper F631 is rotated towards guide surface S201, thereby providing access to media path 212 (and blocking media path 211). Pinch rollers 221 can then drive media in a media direction 292 through media path 212. Once again, the monolithic design of tip portion T631 and director body B630 eliminates surface discontinuities at joint J631, pinch rollers 221 can also drive media in the opposite direction (as indicated by the two-headed arrow) at high speed without encountering stubbing at joint J631. In this manner, articulating tip 631 can improve the bi-directional paper transport capabilities of a director module (e.g., director module 200 shown in FIG. 2A).

Note that according to another embodiment of the invention, flipper F631 could be eliminated by forming tip portion T631 from shape memory material. Tip portion T631 could then be moved between desired operating positions (such as shown in FIGS. 6A and 6B) through the application of appropriate control signals (e.g., thermal, magnetic, or electrical) to tip portion T631.

Figure 7A:
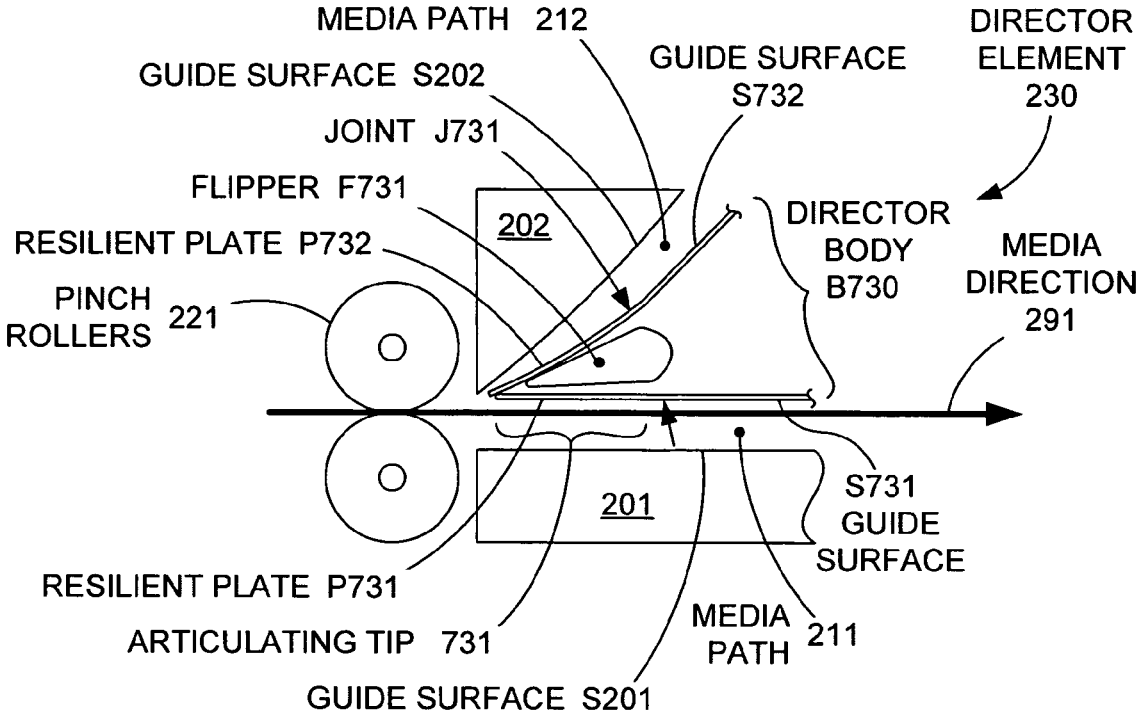
FIGS. 7A and 7B show an articulating tip that is formed from flexible, resilient plates, according to another embodiment of the invention.

FIG. 7A shows a detail view of an articulating tip 731 that could be used in place of articulating tip 231 in FIG. 2A, according to another embodiment of the invention. Articulating tip 731 and a director body are formed by resilient plates P731 and P732. Resilient plates P731 and P732 can be made of plastic, metal or other flexible sheet materials and can be multi-layered or composite in structure. Resilient plates P731 and P732 are configured to have ends that tend to spring towards each other and away from guide surfaces S201 and S202, respectively, of fixed guide elements 201 and 202, respectively. The contacting ends of resilient plates P731 and P732 form articulating tip 731, while the remaining portions of resilient plates P731 and P732 provide guide surfaces S731 and S732, respectively. Guide surfaces S731 and S732 face guide surfaces S201 and S202, respectively, to define media paths 211 and 212, respectively. Resilient plates P731 and P732 can be affixed to director body B730 in various ways, e.g. gluing, riveting, etc.

Meanwhile, a flipper F731 positioned between resilient plates P731 and P732 controls the position of articulating tip 731. Thus, as shown in FIG. 7A, when flipper F731 is rotated towards guide surface S202 to bend resilient plate P732 towards guide surface S202, resilient plate P732 also bends towards guide surface S202. In this manner, access is provided to media path 211 (and media path 212 is blocked). Pinch rollers 221 can then drive media in a media direction 291 through media path 211. Because resilient plate P731 does not present any surface discontinuities at joint J731 (i.e., at the region where resilient plate P731 flexes), pinch rollers 221 can also drive media in the opposite direction (as indicated by the two-headed arrow) at high speed without encountering stubbing at joint J731.

Figure 7B:
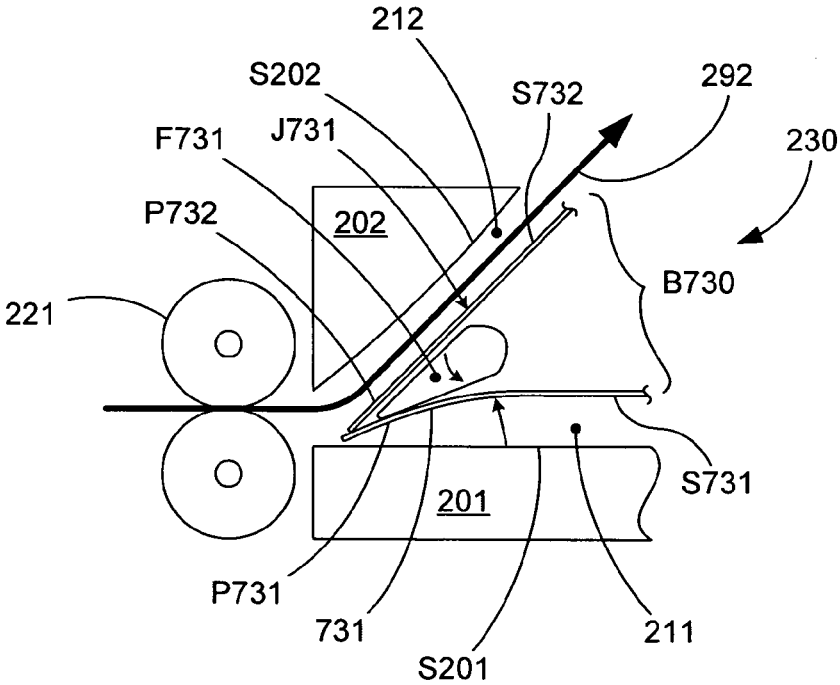

In FIG. 7B, flipper F731 is rotated towards guide surface S201, thereby bending resilient plate P731 towards guide surface S201 of fixed guide element 201. In response, resilient plate P731 also bends towards guide surface S201 and away from guide surface 202, thereby providing access to media path 212 (and blocking media path 211). Pinch rollers 221 can then drive media in a media direction 292 through media path 212. Because resilient plate P732 does not present any surface discontinuities at joint J731 (i.e., at the region where resilient plate P732 flexes), pinch rollers 221 can also drive media in the opposite direction (as indicated by the two-headed arrow) at high speed without encountering stubbing at joint J731. In this manner, articulating tip 731 can improve the bi-directional paper transport capabilities of a director module (e.g., director module 200 shown in FIG. 2A).

Although the present invention has been described in connection with several embodiments, it is understood that this invention is not limited to the embodiments disclosed, but is capable of various modifications that would be apparent to one of ordinary skill in the art. For example, articulating tips 531, 631, and 731 shown in FIGS. 5A, 6A, and 7A, respectively, could be incorporated into conventional (i.e., non-modular) media handling systems to enhance media transport flexibility (i.e., providing bi-directional transport capability) and improve media transport reliability (i.e., by eliminating joint surface discontinuities to minimize the chances of stubbing). Therefore, the invention is limited only by the following claims.

The invention claimed is:

1. A media path director module comprising:

a module frame comprising a first guide surface and a second guide surface; and a director element within the module frame, the director element comprising:

a first director guide surface facing the first guide surface to define a first media path;

a second director guide surface facing the second guide surface to define a second media path; and a first articulating tip, wherein the first director guide surface and the second director guide surface converge towards the first articulating tip, wherein when the first articulating tip is in a first position, the first articulating tip provides access to the first media path and blocks access to the second media path, and wherein when the first articulating tip is in a second position, the first articulating tip provides access to the second media path and blocks access to the first media path, and wherein the module frame further comprises a third guide surface, and wherein the director element further comprises:

a third director guide surface facing the third guide surface to define a third media path;

a second articulating tip, the first director guide surface and the third director guide surface converging towards the second articulating tip, wherein when the second articulating tip is in a third position, the second articulating tip provides access to the first media path and blocks access to the third media path, and wherein when the second articulating tip is in a fourth position, the second articulating tip provides access to the third media path and blocks access to the first media path; and a third articulating tip, the second director guide surface and the third director guide surface converging towards the third articulating tip, wherein when the third articulating tip is in a fifth position, the third articulating tip provides access to the second media path and blocks access to the third media path, and wherein when the third articulating tip is in a sixth position, the third articulating tip provides access to the third media path and blocks access to the second media path.

2. The media path director module of claim 1, wherein a director element body comprises the first director guide surface and the second director guide surface, and wherein the first articulating tip is coupled to the director element body by a first living hinge.

3. The media path director module of claim 2, further comprising a flipper element embedded within the first articulating tip for placing the articulating tip in the first position and the second position.

4. The media path director module of claim 3, wherein the first articulating tip is coupled to the director element body by a second living hinge, wherein the first living hinge forms a first continuous surface with the first director guide surface, and wherein the second living hinge forms a second continuous surface with the second director cuide surface.

5. The media path director module of claim 1, further compricing a flexible skin covering the first articulating tip, the flexible skin providing the first director guide surface and the second director guide surface.

6. The media path director module of claim 1, wherein the director element comprises a monolithic guide element, the monolithic guide element comprising the first articulating tip, the first director guide surface, and the second director guide surface, wherein the articulating tip comprises a first tip surface, the first tip surface forming a first continuous surface with the first director guide surface, and wherein the articulating tip comprises a second tip surface, the second tip surface forming a second continuous surface with the second director guide surface.

7. The media path director module of claim 6, further comprising a flipper element embedded within the articulating tip for placing the tirst articulating tip in the first position and the second position.

8. The media path director module of claim 6, wherein the first articulating tip comprises a shape memory material.

9. The media path director module of claim 1, wherein the director element further comprises:

a first flexible plate;

a second flexible plate; and a flipper element, wherein the first flexible plate and the second flexible plate are configured such that a first end portion of the first flexible plate presses against a second end portion of the second flexible plate to form the first articulating tip, and wherein the flipper element is positioned between the first end portion and the second end portion wherein when the flipper element is moved to a first orientation, the first articulating tip moves to che first position, and wherein when the flipper element is moved to a second orientation, the first articulatng tip moves to the second position.

10. The media path director module of claim 1, further comprising a media drive mechanism for moving flexible media through the first media path and the second media path.

11. The media path director module of claim 1, wherein the when the first articulating tip is in a third position, access is provided to a third media path defined by the media director module, and access to the first media path and the second media path is blocked.

12. A media handling system comprising a plurality of identical media director modules, wherein each of the plurality of identical media director modules comprises:

a module frame comprising a first guide surface and a second guide surface; and a director element within the module frame, the director element comprising:

a first director guide surface facing the first guide surface to define a frst media path;

a second director guide surface facing the second guide surface to define a second media path;

a third director guide surface facing the third guide surface to define a third media path; and a first articulatirg tip;

a second articulating tip; and a third articulating tip, wherein the first director guide surface and the second drector guide surface converge towards the first articulating tip, the first director guide surface and the third director guide surface converge towards the second articulating tip, and the second director guide surface and the third director guide surf ace converge towards the third articulating tip, wherein when the first articulating tip is in a first position, the first articulating tip provides access to the first media path and blocks access to the second media path, wherein when the first articulating tip is in a second position, the first articulating tip provides access to the second media path and blocks access to the first media path, wherein when the second articulating tip is in a third position, the second articulating tip provides access to the first media path and blocks access to the third media path, wherein when the second articulating tip is in a fourth position, the second articulating tip provides access to the third media path and blocks access to the first media path, wherein when the third articulating tip is in a fifth position, the third articulating tip provides access to the second media path and blocks access to the third media path, wherein when the third articulating tip is in a sixth position, the third articulating tip provides access to the third media path and blocks accoss to the second media path.

13. The media handling system of claim 12, further comprising logic for controlling the first articulating tip of each of the plurality of identical media director modules to selectively create a first media transport path between a first input location and an output location and a second media transport path between a second input location and the output location.

* * * * *